United States Patent [19]

Chung

[11] Patent Number: 4,867,830

[45] Date of Patent: Sep. 19, 1989

[54] METHOD OF TABBING PRESSURE SENSITIVE TAPE

[76] Inventor: Nan Y. Chung, 825 Buttonwood La., Langhorne, Pa. 19047

[21] Appl. No.: 268,779

[22] Filed: Nov. 9, 1988

Related U.S. Application Data

[62] Division of Ser. No. 199,049, May 26, 1988.

[51] Int. Cl.[4] ..... B32B 31/18

[52] U.S. Cl. ..... 156/267; 156/289; 156/522

[58] Field of Search ..... 156/267, 250, 522, 289; 242/58, 58.5, 59

[56] References Cited

U.S. PATENT DOCUMENTS

| | | | |
|---|---|---|---|
| 3,939,034 | 2/1976 | Tanaka et al. | 156/522 |
| 4,227,955 | 10/1980 | Woods et al. | 156/522 X |
| 4,227,960 | 10/1980 | Loeffler et al. | 156/519 X |

*Primary Examiner*—Michael W. Ball

*Assistant Examiner*—Michele K. Yoder

*Attorney, Agent, or Firm*—John R. Ewbank

[57] ABSTRACT

In a factory for producing rolls of pressure sensitive tape, a tab is applied to the end of such tape by a series of steps comprising: advancing a strip of tab material onto a work station; positioning a placement zone of such tape onto a temporary positioning zone of a workstation and onto the perpendicularly aligned strip of tab material so that the tape adheres to such strip of tab material; cutting off and discarding that segment of the tape forward of the edge of the tab; lifting the tape from its temporary positioning zone at the rearward portion of said workstation; advancing the combination of the strip of tab material and the tape laminated thereto so that on the workstation there is exposed the strip of material for the next tape; and cutting off the strip of tab material at the edge of the tape, so that the tabbed tape is liberated from the workstation zone. Such process can be practiced using either a hand held applicator or a bench mounted applicator.

1 Claim, 3 Drawing Sheets

FIG. 5
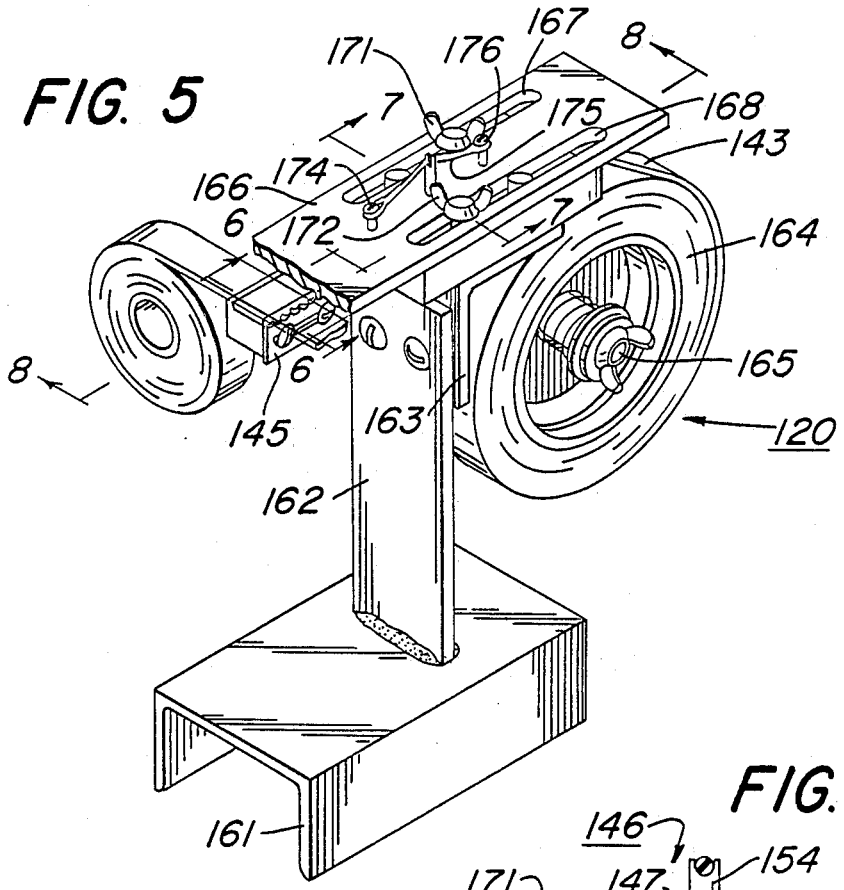
FIG. 7
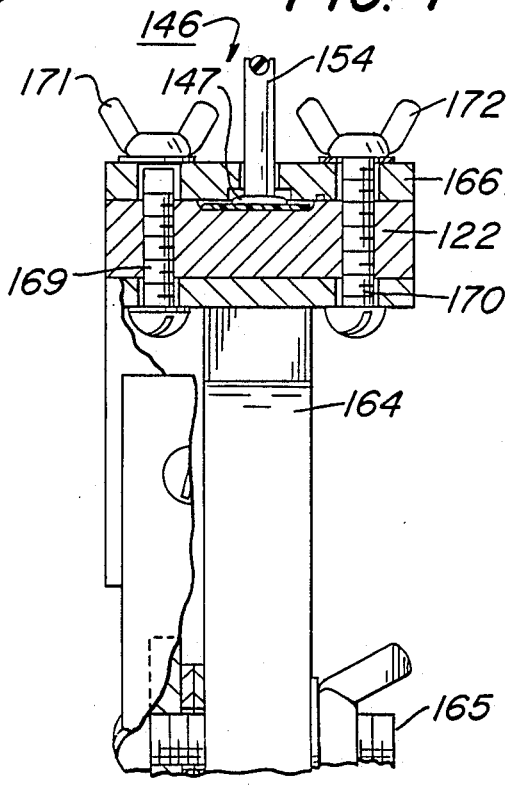
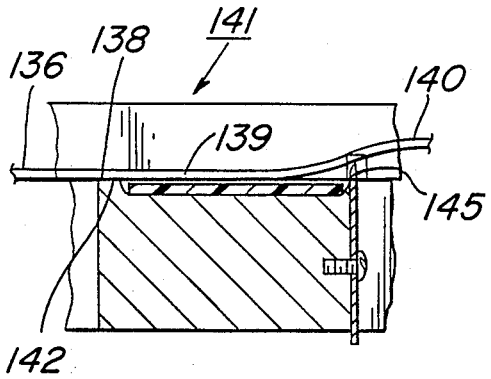
FIG. 6

164
165
143
166
168
175
173
154
146
163
174
162
120
135
143

METHOD OF TABBING PRESSURE SENSITIVE TAPE

This is a division of parent application Ser. No. 199,049, filed May 26, 1988.

BACKGROUND

1. Field of Invention

The invention relates to methods and apparatus for applying tabs to the end of pressure sensitive tape. In a factory for producing rolls of pressure sensitive tape, such tab application is subsequent to formation of the roll of tape.

2. Prior Art

For several decades, it has been customary to market rolls of pressure sensitive tape with a tab at the forward end thereof. In retail stores, if a shoplifter steals a short length of tape from a roll, the appearance of the roll is changed so that a prospective buyer can recognize a tampered roll. Such use of tabs has had a deterrent effect minimizing such shoplifting.

Those types of tapes which are produced in large quantities merit the use of sophisticated automated machinery requiring little handling of the rolls by humans. However, wide tapes, colored tapes, and/or other specialty items must be processed so that an appropriate tab is applied by a worker. It has been standard practice for the workers to employ scissors for cutting the end of the tape and/or for cutting the end of the strip of tab material when applying the tab to such tape.

Heretofore there have been machines which fed strips of material from directions which differed by a right angle. Loeffler et al U.S. Pat. No. 4,227,960 advances a web of jacketing material through a zone in which a strip of pressure sensitive tape advances from a perpendicular direction so that the tape is applied across the width of the advancing web. Woods et al U.S. Pat. No. 4,227,955 applies sealing tapes to both ends of a carton, the tapes having pull tabs for expediting the opening of the carton.

SUMMARY OF THE INVENTION

In accordance with the present invention, a tab is applied to the end of a roll of pressure sensitive tape by a series of steps comprising: advancing a stip of tab material onto a work station so that the forward end of such strip is at a position scheduled to recieve an edge of a pressure sensitive tape; positioning a placement zone of the pressure sensitive tape onto a temporary positioning zone of said work station and onto the strip of tab material so that said strip of tab material on such work station adheres to the pressure sensitive tape, one edge of the pressure sensitive tape being aligned with one edge of the work station, and the tape being aligned at a right angle to the path of the strip of tab material; cutting off (ie. tearing and discarding that segment of the pressure sensitive tape forward of the pressure sensitive tape adhered to the strip of tab material; lifting the tape from the temporary positioning zone; manually pulling the laminated tape sideways to advance onto the strip supporting surface of the work station sufficient strip material for the next tape; immobilizing the thus advanced strip of tab material; and cutting off (ie. tearing) the strip of tab material at the edge of the tape, thereby liberating the tabbed tape from the workstation. A tab applicator tool useful in practicing such method comprises the combination of a workstation adapted to accomodate a predetermined length of a strip of tab material positioned at right angles to a width of the forward end of a roll of pressure sensitive tape, said work station comprising a temporary positioning zone having an exposed area which is a small fraction of the area of the strip of tab material on said workstation, said temporary positioning zone being immediately rearward of said strip of tab material on said workstation; a tape cutting means at the forward edge of the workstation, adapted to cut the tape at the edge of the tab while the tape is temporarily adhered to the temporary positioning zone; means for cutting the strip of tab material, said means being at the edge of the workstation corresponding to the most forward advancement of the strip of tab material, said cutting means being adapted to cut the strip of tab material subsequent to the adhering of the tape to the strip of tab material. In a bench model of said tool for said method, there is a combination comprising : a base; means for mounting a roll of tab material; a strip-supporting surface in a workstation, said surface having an area directing said strip of tab material from one edge to the other edge across said work station; a temporary positioning zone having an effective adhering area which is a small fraction of the area of said strip-supporting surface in the workstation, such effective adhering area of the temporary positioning zone being raised above the level of said strip supporting surface approximately as much as the thickness of the strip of tab material, and said temporary positioning zone being immediately rearward of said strip-supporting surface; a tape cutting means immediately forward of said strip-supporting surface, the effective height of the tape cutting means being only slightly higher than the top of the laminated combination of tab material and tape, whereby a forward segment of the tape is cut when the tape is subjected to the movement of being temporarily adhered to said temporary positioning zone, and adhered to the strip of tab material; and tab strip cutting means at the edge of the workstation so that the tabbed end of the tape can be liberated from the strip of tab material. In a hand held tool, the strip of tab material advances through the handle so that an edge of the workstation can provide a cutting means for tearing or cutting the strip of material. Said hand tool has a tape cutting means which, with respect to advancement of the pressure sensitive tape, is forward of the strip-supporting surface. A temporary positioning zone is rearward of said strip-supporting surface.

After the strip of tab material has been advanced onto the work station, a forward end of a roll of pressure sensitive tape can be manually positioned onto the temporary positioning zone, and a portion just forward thereof adhered to the strip of tab material, and the excess tape is inherently cut off at the edge of the tab material, all three results being accomplished by a simple manual movement of the tape onto the tool having the tape cutting knife at the correct position for such tabbing by a simple manual movement.

The tape can then be lifted from clinging to the positioning zone and manually pulled sidewise, thereby pulling sufficient tab material across the workstation for use by the next roll of pressure sensitive tape. Then the strip can be immobilized. The tabbed tape can then be liberated from the strip of tab material by pulling the tabbed tape sideway to pull additional tab material strip onto the workstation, and as soon as the predetermined length of tab material is on the work station, cutting the strip of tab material from the tabbed tape.

In preferred embodiments of the tool, retaining means can restrict the forward movement of the strip of tab material so that it can be manually advanced when desired, or manually held during the cutting or tearing of the strip material.

BRIEF DESCRIPTION OF THE DRAWINGS

FIG. 5 is a schematic perspective view of a bench-mounted tool useful as a tab applicator.

FIG. 6 is a sectional view at lines 6—6 of FIG. 5.

FIG. 7 is a sectional view at lines 7—7 of FIG. 5.

DESCRIPTION OF TWO PREFERRED EMBODIMENTS

Figure 1:
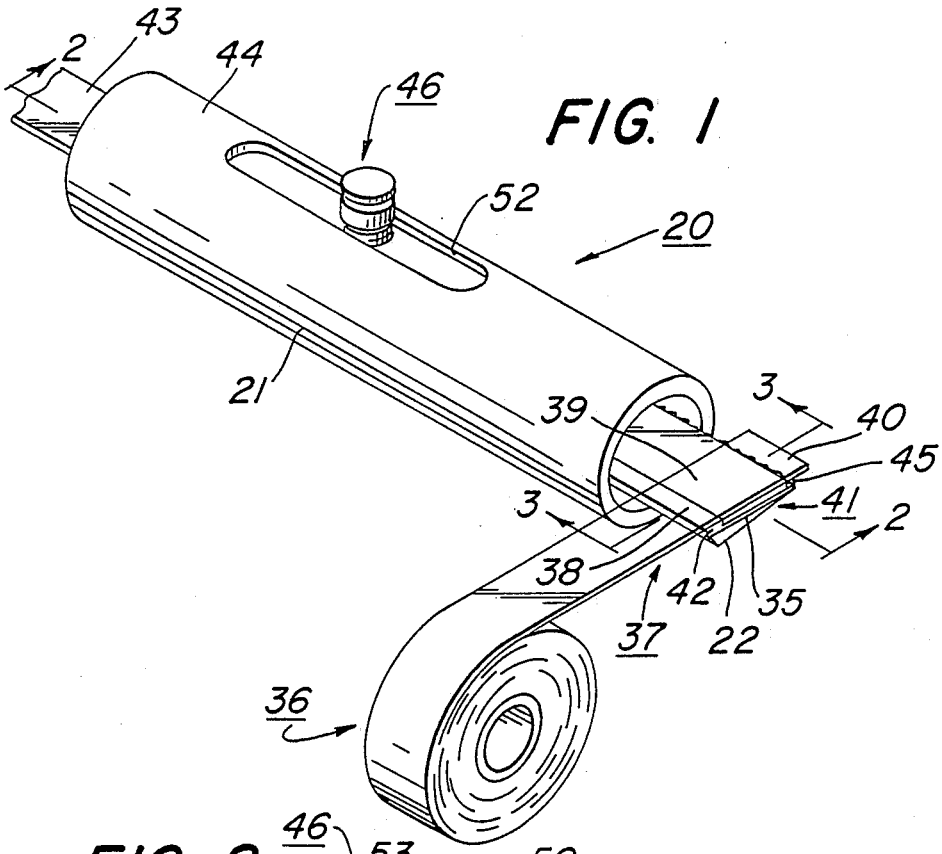
FIG. 1 is a schematic perspective view of a hand-held tool useful for applying a forward portion of a roll of pressure sensitive tape to a portion of a strip of tab material, and prior to the cutting of the excess tape.
Figure 2:
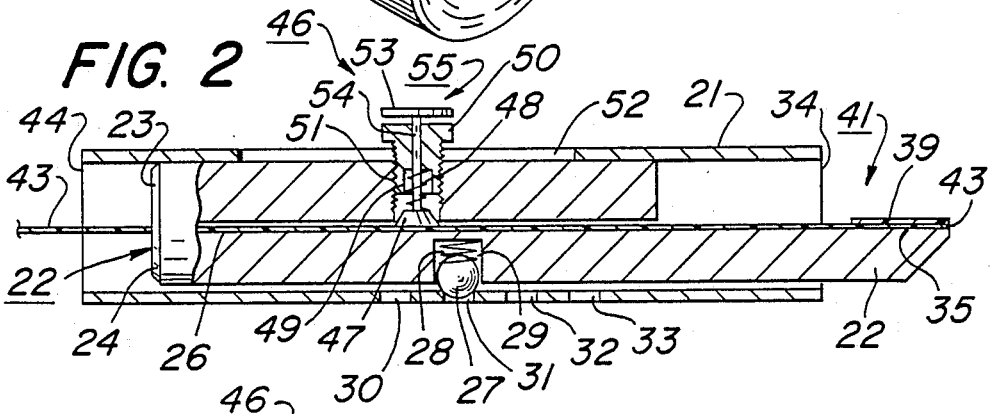
FIG. 2 is a sectional view taken at lines 2—2 of FIG. 1.
Figure 3:
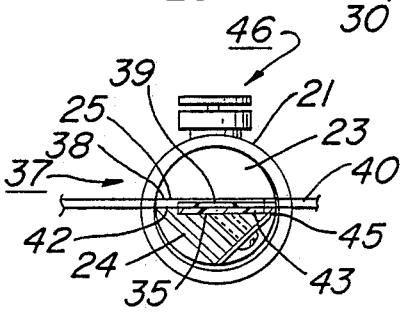
FIG. 3 is a sectional view taken at lines 3—3 of FIG. 1.
Figure 4:
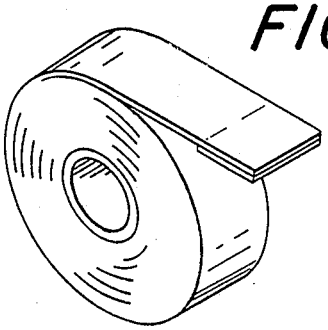
FIG. 4 is a schematic view of a roll of pressure sensitive tape having a tab which has been applied with the tool of FIG. 1.
Figure 8:
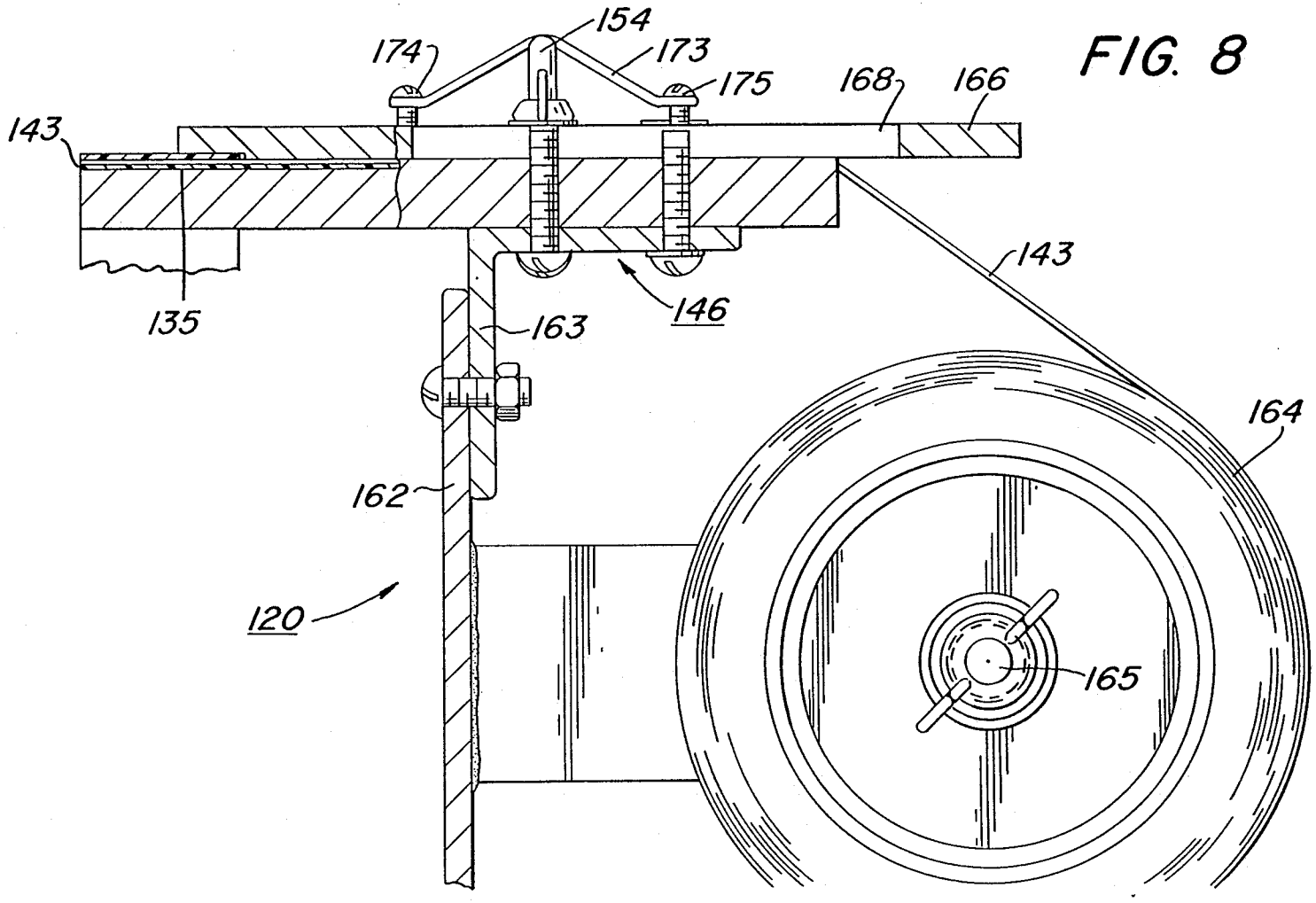
FIG. 8 is a sectional view at lines 8—8 of FIG. 5

A hand-held tool 20 of FIGS. 1–3 includes a hollow tube 21 in which a bar 22 is slideably mounted. An upper portion 23 of said bar does not extend as far forward as does a lower portion 24, there being a horizontal slot 25 [FIG. 3] between such upper and lower portions. The bottom of said slot 25 is a strip-supporting surface 26. A ball 27, yieldingly urged outward by a spring 28 in a well 29 in said bar can engage with any of several holes 30,31, 32, and 33. Said bar 22 can extend beyond the forward portion 34 of said tube 21 by distances predetermined by the positioning of said holes 30–33. Such predetermined distances correspond to the various widths of pressure-sensitive tape scheduled for tabbing.

At the rear portion of bar 22, the horizontal slot 25 has a bottom surface functioning as the strip-supporting surface 26. At the forward portion of the bar, a strip-supporting surface 35 is an exposed forward extension of strip-supporting surface 26.

A manually held roll of pressure sensitive tape 36 has a forwardly leading portion 37 manually directed toward said tool 20. Such leading portion 37 of the tape 36 comprises a placement zone 38, a tabbing zone 39, and a grabbable zone 40 suitable for grabbing by the operator in conducting the tabbing process.

The thus extended portion of bar 22 has a workstation 41 comprising said strip-supporting surface 35 [a forward extension of strip-supporting surface 26] and a temporary positioning zone 42 adapted to position said placement zone 38 of said pressure sensitive tape 36. A strip 43 of tab material advances from an unshown supply source through a rear portion 44 of said tube 21 along the strip supporting surface 26. Said temporary positioning zone 42 is desirably about as much higher than the strip supporting surface 35 as is the thickness of the strip 43, so that the tabbing zone 39 of tape 36 is at about the same level as the placement zone 38 of the tape adhering temporariliy to the positioning zone 42.

The workstation 41 features a tape cutter 45 at the edge opposite from said temporary positioning zone 42. Such tape cutter 45 is shown schematically [but not actually necessarily as serrated. The effective cutting edges of tape cutter 45 are at a level sufficiently higher than said strip-supporting surface 35 that the tape is cut when the operator, by a single movement presses the tape against the temporary postioning zone and the strip of tab material so that lamination and cutting are accomplished by such single movement.

Restraining means 46 comprises a restraining pad 47 [FIG. 2] yieldingly pushing the strip 43 against the strip-supporting surface 26 by reason the the action of a spring 48 in a well 49 of an adjusting screw 50 having interthreaded connection with a threaded bore 51 in upper portion 23 of bar 22. Said adjusting screw 50 extends upwardly through and is adapted to slide in a longitudinal slot 52 on top of the tube 21. The extension of such screw 50 above the tube 21 also serves as a handle for adjusting the ball 27 in an appropriate hole 30–33 when readjusting for a change of width of tape.

When an operator desires to increase the restraining pressure on the strip 43, as when the strip is to be torn and/or cut, downward pressure is applied to a button 53 connected thru stem 54 to said restraining pad 47, the combination of restraining pad 47, stem 54, and button 53 being designated as a restraining member 55. The adjusting screw 50 can be turned to increase or decrease the spring pressure of the pad 47 on the strip 43.

In practicing the method of the present invention, the grabbable portion 40 of the roll of tape 36 is manually moved so that the placement zone 38 of the tape 36 clings temporarily to the temporarily positioning zone 42 and the tabbing zone 39 adheres to the strip 43 of tab material, and tape cutter 45 cuts tape 36 so that grabbable portion 40 is severed from the laminated combination of tape 36 and strip 43.

Such laminated combination is then manually pulled forwardly, pulling additional additional strip 43 onto said workstation 41, until the other edge of such laminated combination is at the forward edge of the workstation 41. Button 53 is pushed downwardly so that restraining pad 47 is pushed against strip 43 for temporarily immobilizing strip 43. A downward pressure on the laminated combination permits the cutting of the immobilized strip, the sharp forward edge of such workstation acting as a knife and/or tearing edge, thereby liberating the laminated combination. The workstation then has the strip ready for another roll of pressure sensitive tape.

When using pressure-sensitive tape having a width different from that shown, then the bar 22 is shifted in or out to one of the positions preselected by the location of holes 30, 32, or 33 instead of allowing the spring-actuated ball 27 to be positioned in hole 31 as shown. The adjustment screw 50 and/or workstation 41 can be handled for making such shift.

The embodiment shown in FIGS. 5–8 is a bench model of a tool adapted for practicing the method described in connection with the hand-held tool of FIGS. 1–4. Some parts for the bench tool which are reasonably similar to corresponding parts of the hand tool are assigned numbers 100 greater than assigned to the hand tool part. A bench tool 120 includes a base 161 supporting a column 162 to which a wall 163 is attached. A roll 164 of tab material 143 is rotatively mounted on a hub 165 so that the tab material can be pulled and advanced through a restraining means 146 to a strip supporting surface 135 of a workstation 141.

A tape cutting knife 145 is at one edge of said workstation 141. A temporary positioning zone 142 is at the opposite edge of the workstation 141. A roll of pressure-sensitive tape 136 is manually moved so that a placement zone 138 of tape 136 clings temporarily to the positioning zone 142, and the tabbing zone 139 of the tape 136 is laminated to the strip of tab material 143, and the grabbable zone 140 of tape 136 is severed by knife 145 from the laminate of the tape 136 and tab material 143.

Then the placement zone 138 of tape 136 is lifted from the positioning zone 142. Then combination of the roll of tape 136 and the laminated tapestrip of tab material are pulled from the workstation for the purpose of pulling fresh tab material to the workstation 141. Such pulling is terminated as soon as a length of tab material for the next tape has been advanced onto the workstation.

Further advancement of the strip of tab material is temporarily stopped by pressing downwardly on stem 154 so that restraining pad 147 is pushed against strip 143 for temporarily immobilizing such strip 143. The tabbed tape is liberated from the freshly advanced strip by tearing or cutting the strip 143 against the sharp edge of workstation 141. Thus the method of tabbing the tape is substantially the same using either the hand-held tool or the bench tool.

In FIGS. 5–8, the adjustment for various widths of tape 136 is achieved by adjusting the position of cover 166, which has two elongated slots 167, 168 accomodating bolts 169, 170. When wing nuts 171,172 are tightened, the cover 166 is temporarily held at a position for a preselected width of tape.

In FIGS. 5–8, the restraining means comprises a restraining pad 147 at the bottom of a stem 154 so that downward pressure on such stem controls the ease with which the strip of tab material can be advanced. Rubber bands 173 can apply downward pressure on stem 154 because they are stretched between bolts 174, 175. When the operator wants to temporarily lock the position of the strip of tab material, downward pressure can be applied to stem 154.

The knife 145 can be serrated and can be secured to the workstation 141 using elongated slots for permitting adjustments to adapt to various widths of tape.

Various modifications of the invention are possible, and the described embodiments are merely illustrative of two embodiments of a tool appropriate for practicing the method of the present invention.

| GLOSSARY | |
|---|---|
| 20 TOOL | 120 bench tool |
| 21 HOLLOW TUBE | |
| 22 BAR | 122 bar having 126 |
| 23 UPPER PORTION OF BAR | |
| 24 LOWER PORTION OF BAR | |
| 25 HORIZONTAL SLOT | |
| 26 STRIP SUPPORTING SURFACE | 126 strip supporting surface |
| 27 BALL | |
| 28 SPRING | |
| 29 WELL | |
| 30,31,32,33 HOLES | |
| 34 FORWARD PORTION OF BAR | |
| 35 FORWARD PORTION OF STRIP SUPPORTING SURFACE | |
| 36 ROLL OF PRESSURE SENSITIVE TAPE | 136 roll of tape |
| 37 FORWARD PORTION OF TAPE | 137 forward portion of tape |
| 38 PLACEMENT ZONE OF TAPE | 138 placement zone of tape |
| 39 TABBING ZONE OF TAPE | 139 tabbing zone of tape |
| 40 GRABBABLE ZONE OF TAPE | 140 grabbable zone of tape |
| 41 WORKSTATION | 141 workstation |
| 42 TEMPORARY POSITIONING ZONE | 142 temporary positioning zone |
| 43 STRIP OF TAB MATERIAL | 143 strip of tab material |
| 44 REAR PORTION OF TUBE | |
| 45 TAPE CUTTER | 145 tape cutter |
| 46 RESTRAINING MEANS | 146 restraining means |
| 47 RESTRAINING PAD | 147 restraining pad |
| 48 SPRING | |
| 49 WELL | |
| 50 ADJUSTING SCREW | |
| 51 THREADED BORE IN 23 UPPER PORTION OF BAR | |
| 52 LONGITUDINAL SLOT IN TUBE 21 | |
| 53 BUTTON | |
| 54 STEM | 154 stem |
| 55 RESTRAINING MEMBER | |
| | 161 base |
| | 162 column |
| | 163 wall |
| | 164 roll of tab material |
| | 165 hub for roll |
| | 166 cover |
| | 167–8 elongated slots in cover |
| | 169–170 bolts upward thru slots |
| | 171–172 wing nuts for bolts |
| | 173 rubber bands |
| | 174–5 bolts |

The invention claimed is:

1. A method for manually applying a tab to the end of a roll of pressure sensitive tape which includes the steps of: manually advancing a strip of tab material along a strip supporting surface of a tool for tabbing pressure sensitive tape so that a predetermined length of strip of tab material is exposed upon a workstation of said tool, said predetermined length being adjusted to match the width of pressure sensitive tape to be tabbed; manually grabbing a grabbable portion of a forward portion of a roll of pressure sensitive tape and pulling said pressure sensitive tape at substantially a right angle to said predetermined length of tab material; positioning a placement zone of said pressure sensitive tape clinging to a temporary positioning zone of said workstation before lamination to the tab material ; adhering and laminating the pressure sensitive tape to said predetermined length of tab material on said workstation; tearing the grabbable portion of the pressure sensitive tape from the laminated combination of pressure sensitive tape and strip of tab material, said combination of steps of clinging, laminating, and tearing being substantially a single swinging movement; lifting said placement zone of said pressure sensitive tape from said temporary positioning zone of said workstation; pulling the laminated combination of pressure sensitive tape and strip of tab material to advance strip material onto said work station in preparation for the next roll of pressure sensitive tape, the distance pulled matching the width of the pressure sensitive tape to be tabbed; and tearing the strip of tab material at a forward edge of said workstation to liberate the tabbed tape from said strip of tab material.

* * * * *